US008808015B2

(12) United States Patent
Lin et al.

(10) Patent No.: US 8,808,015 B2
(45) Date of Patent: Aug. 19, 2014

(54) ELECTRONIC DEVICE WITH PROTECTING MEMBER PREVENTING DISASSEMBLY DURING USE

(71) Applicant: Hon Hai Precision Industry Co., Ltd., New Taipei (TW)

(72) Inventors: Sheng-Yen Lin, New Taipei (TW); Feng-Liang Liao, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 94 days.

(21) Appl. No.: 13/625,880

(22) Filed: Sep. 25, 2012

(65) Prior Publication Data

US 2013/0084722 A1 Apr. 4, 2013

(30) Foreign Application Priority Data

Sep. 30, 2011 (TW) ..... 100218419 U

(51) Int. Cl.
*H01R 13/44* (2006.01)

(52) U.S. Cl.
USPC ..... 439/144

(58) Field of Classification Search
USPC ..... 439/144, 34–35, 455, 452, 135–136, 439/372, 152, 676
See application file for complete search history.

(56) References Cited

U.S. PATENT DOCUMENTS

| | | | | |
|---|---|---|---|---|
| 6,848,949 | B2 * | 2/2005 | Mullaney et al. | 439/676 |
| 8,337,222 | B2 * | 12/2012 | Hung et al. | 439/138 |
| 8,419,459 | B2 * | 4/2013 | Nihei et al. | 439/341 |
| 8,500,468 | B2 * | 8/2013 | Gravolin et al. | 439/144 |
| 8,535,071 | B1 * | 9/2013 | Mueller | 439/144 |
| 2007/0072461 | A1 * | 3/2007 | Williams et al. | 439/144 |

* cited by examiner

*Primary Examiner* — Jean F Duverne
(74) *Attorney, Agent, or Firm* — Novak Druce Connolly Bove + Quigg LLP

(57) ABSTRACT

An exemplary electronic device includes a front wall and a protecting member. The font wall includes a socket used to engagingly receive a plug and a fixing member used to fix the front wall to a side wall associated with the electronic device. The protecting member is located between the socket and the fixing member and slidably attached to the front wall to selectively shield at least part of the socket or shield the fixing member. When the protecting member shields at least part of the socket, the fixing member is exposed to allow the front wall to be disassembled from the side wall. When the protecting member shields the fixing member, the socket is entirely exposed to allow the plug to be inserted into the socket.

20 Claims, 4 Drawing Sheets

ELECTRONIC DEVICE WITH PROTECTING MEMBER PREVENTING DISASSEMBLY DURING USE

BACKGROUND

1. Technical Field

The present disclosure relates to electronic devices, and more particularly to an electronic device with a protecting member that is used to protect the electronic device from being inadvertently disassembled while the electronic device is still in use.

2. Description of Related Art

In many electronic devices, for example, desktop computers, servers, and Internet appliances, a power supply device is required to provide power to the electronic device. The electronic device is able to be used while the power supply device is connected to the electronic device. However, in general, the electronic device is also able to be inadvertently disassembled while still remaining connected to the power supply device. When this happens, a user or operator is liable to suffer injury or worse, and the electronic device is liable to sustain damage.

Therefore, a need exists in the industry to overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

FIG. 4 is similar to FIG. 3, but showing the plug connected to the electronic device, and the electronic device powered on.

DETAILED DESCRIPTION

Figure 1:
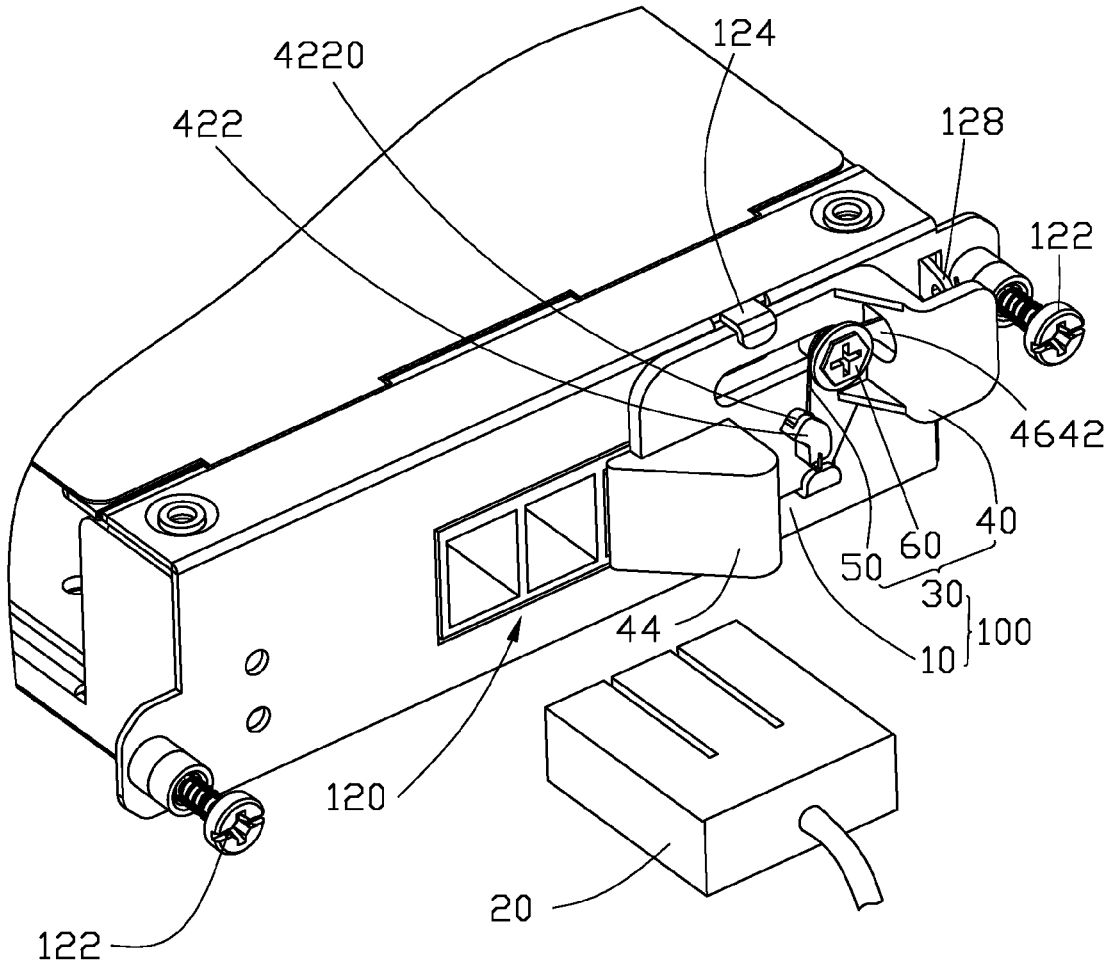
FIG. 1 is an assembled, isometric view of part of an electronic device having a protecting member in accordance with the present disclosure, also showing a plug disconnected from the electronic device.

The disclosure is illustrated by way of example and not by way of limitation in the figures of the accompanying drawings in which like reference numerals indicate the same or similar elements. It should be noted that references to "an" or "one" embodiment in this disclosure are not necessarily to the same embodiment, and such references can mean "at least one."

Figure 2:
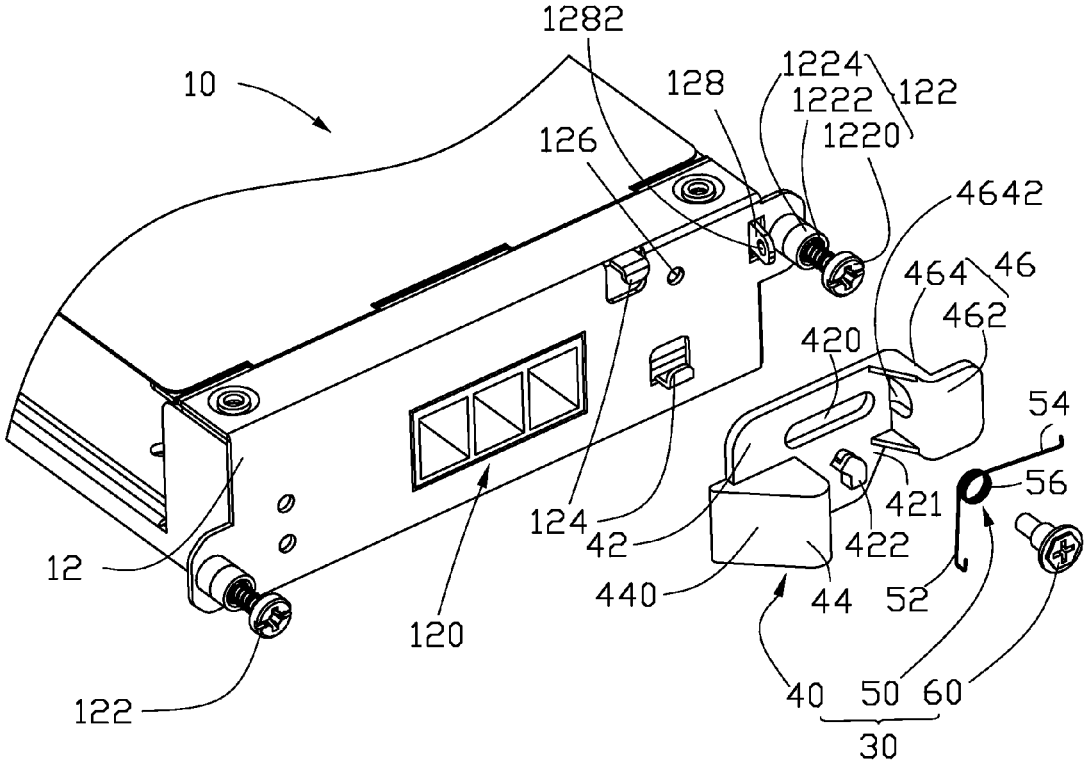
FIG. 2 is an exploded view of the electronic device and the protecting member of FIG. 1.
Figure 3:
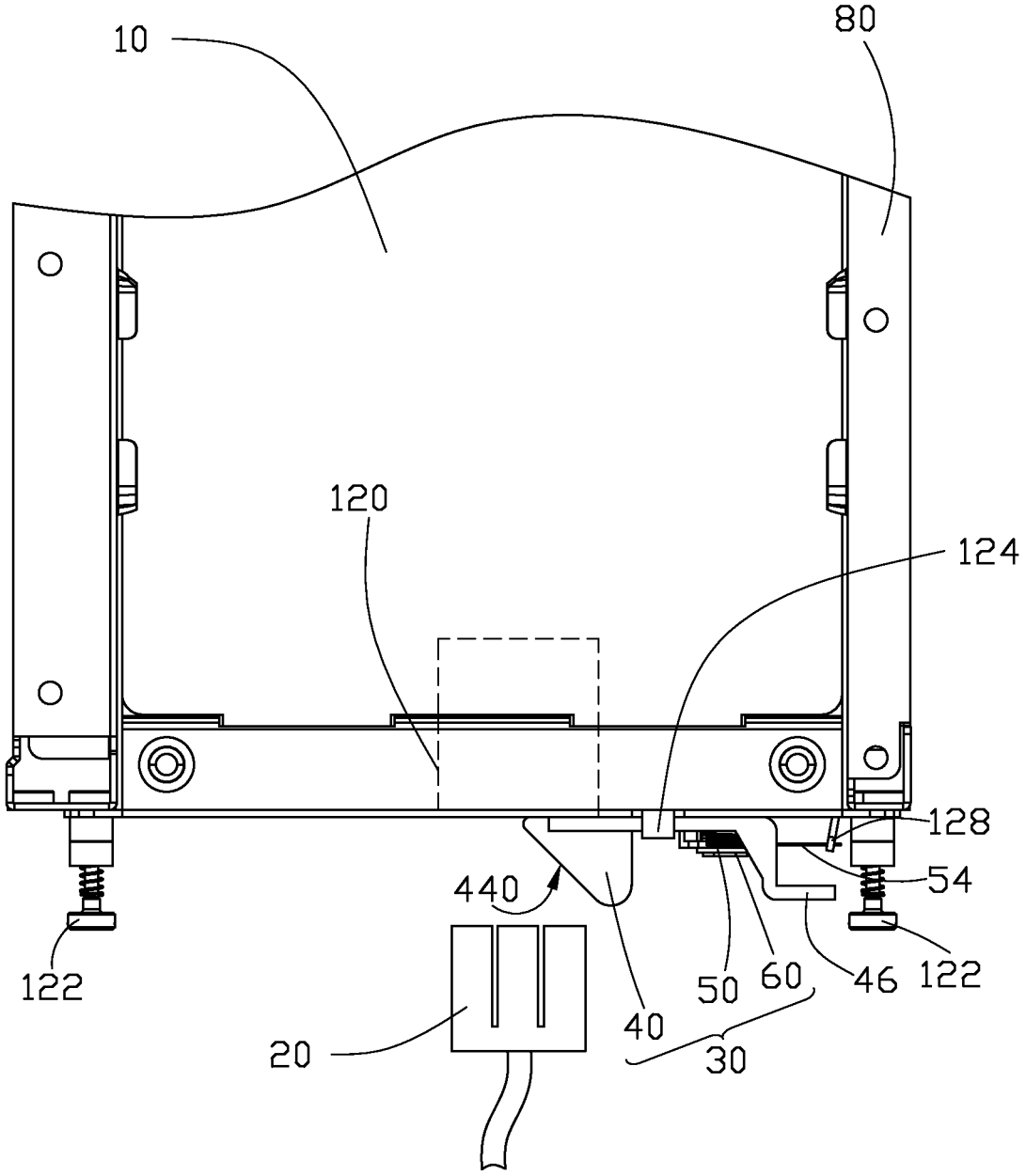
FIG. 3 is similar to a top plan view of the electronic device of FIG. 1, showing the plug disconnected from the electronic device, and the electronic device powered off and able to be disassembled.

Referring to FIGS. 1-3, an electronic device 100 comprises a housing 10 and a protecting member 30 slidably connected to the housing 10. The housing 10 is configured for accommodating electronic elements, such as printed circuit boards (PCBs), batteries, a central processing unit (CPU), etc. The housing 10 is substantially rectangular and it will be understood that other configurations may be utilized instead.

The housing 10 comprises a front wall 12 and a side wall 80. The front wall 12 includes a socket 120, a pair of fixing members 122, a pair of positioning portions 124, a hole 126, and a retaining portion 128. The pair of fixing members 122 are used to fix the front wall 12 to the side wall 80. In the following description, it is assumed that the side wall 80 is U-shaped, with free ends of the side wall 80 attached to opposite sides of the front wall 12, respectively. The side wall 80 may for example be configured as part of the housing 10, or as part of a securing bracket (not shown), or as part of an enclosure of a communications device (not shown). tThat is, in the latter two of these examples, the fixing members 122 are used to fix the front wall 12 of the electronic device 100 to the side wall 80 of an associated device. In other examples, the fixing members 122 are used to fix the front wall 12 of the electronic device 100 to any other part of an associated device besides a side wall of the associated device. The socket 120 is located between the pair of fixing members 122. The pair of positioning portions 124, the hole 126 and the retaining portion 128 are located generally between the socket 120 and a right one of the pair of fixing members 122. The retaining portion 128 is located between the hole 126 and the right fixing member 122, and is next to the right fixing member 122.

The socket 120 is used to engagingly receive a plug 20. In this embodiment, the socket 120 defines three ports. The plug 20 is inserted into the socket 120 to provide power to the electronic device 100.

The pair of positioning portions 124 are arranged offset relative to each other, and cooperatively engage with the protecting member 30 to limit movement directions of the protecting member 30. In the illustrated embodiment, the positioning portions 124 are in the form of hooks, wherein a cross-section of each of the positioning portions 124 is L-shaped. A free end of a top one of the positioning portions 124 points downward, and a free end of a bottom one of the positioning portions 124 points upward. The positioning portions 124 engage with two opposite edges of the protecting member 30, respectively, such that the protecting member 30 is slidable in horizontal directions between the positioning portions 124.

The pair of fixing members 122 are positioned at two diagonally opposite corners of the front wall 12, to attach the front wall 12 to the side wall 80. Each of the fixing members 122 includes a screw 1220, a spring 1222, and a sleeve 1224. An end of the sleeve 1224 is provided with self-locking internal threads to prevent the screw 1220 from freely disengaging from the sleeve 1224. The spring 1222 is attached to the screw 1220 and positioned between the sleeve 1224 and a head of the screw 1220, to help the screw 1220 to move clear of the side wall 80 when the screw 1220 is disengaged from the side wall 80.

Figure 4:
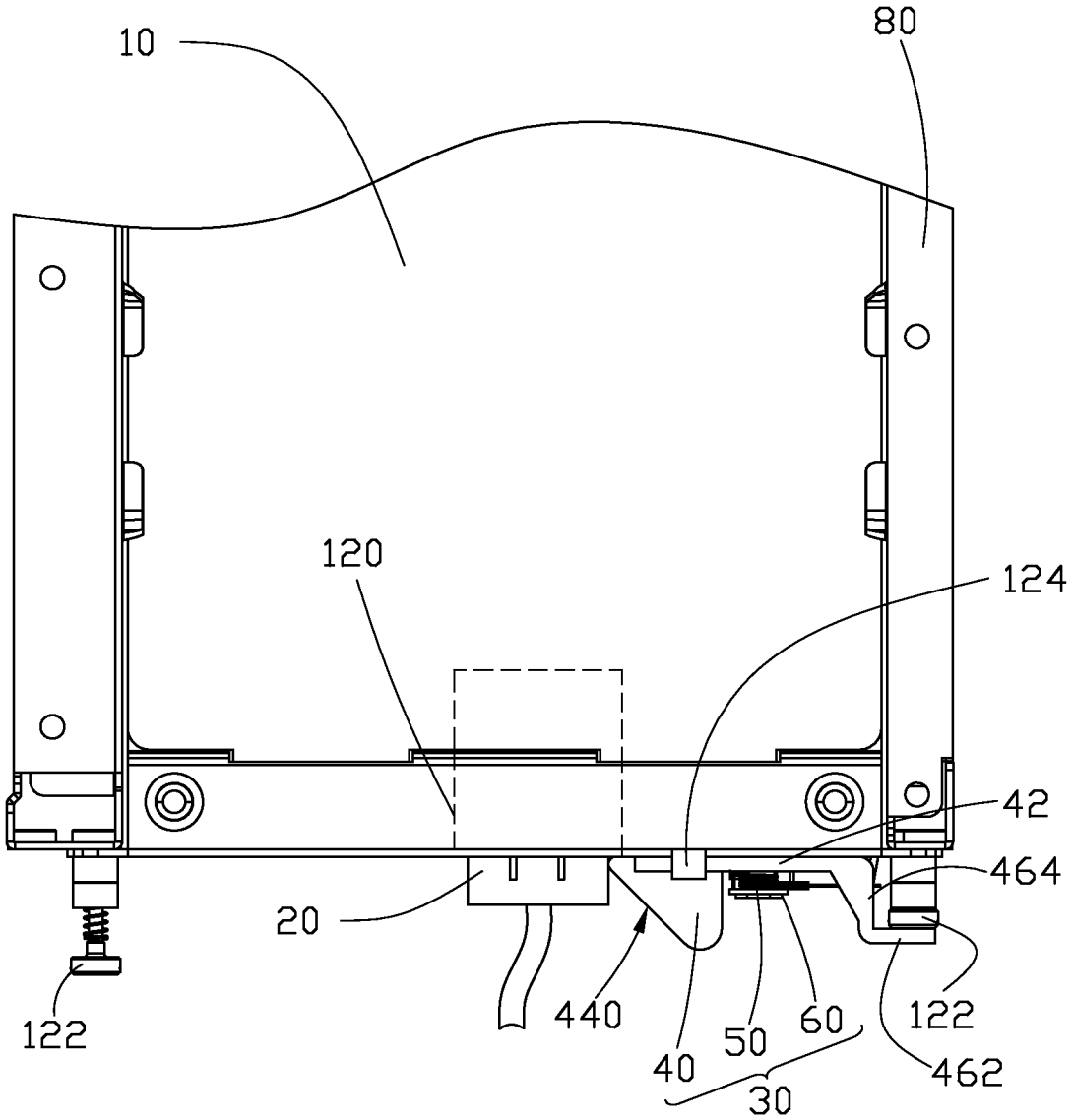

The protecting member 30 is configured for helping prevent the front wall 12 from being disengaged from the side wall 80 when the electronic device 100 is powered on. The protecting member 30 is slidably attached to the front wall 12, and located between the socket 120 and the right fixing member 122. The protecting member 30 can slide relative to the front wall 12 of the housing 10, either to shield part of the socket 120 (as shown in FIG. 3), or to move away from the socket 120 to allow the plug 20 to be inserted into the socket 120 (as shown in FIG. 4). When the plug 20 is inserted into the socket 120 to provide power to the electronic device 100, the protecting member 30 shields the right fixing member 122, to prevent the right fixing member 122 from being disengaged from the side wall 80.

In this embodiment, the protecting member 30 is also elastically connected to the front wall 12. The protecting member 30 comprises a slider 40, a torsion spring 50, and a fastener 60. In the illustrated embodiment, the fastener 60 may be a screw. The slider 40 comprises a body 42, a first shielding portion 44, and a second shielding portion 46. The body 42 closely and slidably abuts the front wall 12. The first shielding portion 44 and the second shielding portion 46 are respectively configured on two opposite sides of the body 42, and are respectively close to the socket 120 and the right fixing member 122.

The body 42 is slidably connected to the front wall 12. The body 42 defines a sliding groove 420 and a securing portion 422. The sliding groove 420 is strip-shaped, and extends between the first shielding portion 44 and the second shielding portion 46. The sliding groove 420 is positioned opposite to the hole 126 of the front wall 12. The fastener 60 passes through the sliding groove 420 and is screwed into the hole 126, to position the slider 40 relative to the front wall 12. The securing portion 422 is formed on an outer surface 421 of the body 42 away from the front wall 12. The securing portion 422 defines a securing slot 4220, which is used to secure the torsion spring 50.

The first shielding portion 44 comprises an inclined surface 440. The plug 20 can be pushed rearward to urge the inclined surface 440 and thereby push the slider 40 rightward away from the socket 120. Finally, the socket 120 is entirely exposed, and the plug 20 can be inserted into the socket 120.

Referring to FIG. 4, the second shielding portion 46 comprises a shielding board 462, and a connecting board 464 connected between the shielding board 462 and the body 42. The connecting board 464 defines a through hole 4642 (see FIG. 2). The shielding board 462 and the body 42 are parallel with each other, and respectively located at two sides of the connecting board 464. The right fixing member 122 is shielded behind the shielding board 462 when the plug 20 is inserted into the socket 120. In this state, disassembly of the front wall 12 of the electronic device 100 (which is powered on) at the right fixing member 122 is not possible. That is, the electronic device 100 can not be disassembled entirely due to the right fixing member 122 being shielded by the protecting member 30 during use.

The torsion spring 50 is used to drive the slider 40 to slide leftward relative to the front wall 12 to shield part of the socket 120. The torsion spring 50 comprises a first fixing end 52, a second fixing end 54, and a central portion 56. The central portion 56 is coiled around the fastener 60 and positioned between the body 42 and a head of the fastener 60. The first fixing end 52 passes through the securing slot 4220 and is fixed to the securing portion 422 of the body 42. The second fixing end 54 passes through the through hole 4642 of the connecting board 464 and is fixed to the retaining portion 128 of the front wall 12. In particular, the second fixing end 54 is fixed in a hole 1282 of the retaining portion 128.

Referring to FIG. 1 and FIG. 3, these show the plug 20 removed from the socket 120, whereby the electronic device 100 is powered off. In this state, the torsion spring 50 is in an original undeformed state. Both the fixing members 122 are entirely exposed, due to the shielding board 462 of the second shielding portion 46 being positioned away from the right fixing member 122. The electronic device 100 can thus be disassembled safely.

Referring to FIG. 4, this shows the plug 20 inserted into the socket 120, whereby the electronic device 100 is powered on. In this state, the torsion spring 50 is in an elastically deformed state. The shielding board 462 of the second shielding portion 46 covers the right the fixing member 122. Disassembly of the front wall 12 of the electronic device 100 at the right the fixing member 122 is not possible.

In summary, the protecting member 30 is slidable between a first position in which the protecting member 30 shields a part of the socket 120, and a second position in which the protecting member 30 shields the right fixing member 122. When the protecting member 30 is in the first position, the right fixing member 122 is exposed to allow the electronic device 100 to be disassembled from the side wall 80. When the protecting member 30 is in the second position, the socket 120 is entirely exposed to allow the plug 20 to be inserted into the socket 120.

Although the features and elements of the present embodiments are described in particular combinations, each feature or element can be used alone or in other various combinations within the principles of the present disclosure to the full extent indicated by the broad general meaning of the terms in which the appended claims are expressed.

What is claimed is:

1. An electronic device, comprising:

a front wall, comprising:

a socket used to engagingly receive a plug; and a fixing member used to fix the front wall to a side wall associated with the electronic device; and a protecting member, located between the socket and the fixing member, and slidably attached to the front wall to selectively shield at least part of the socket or shield the fixing member;

wherein when the protecting member shields at least part of the socket, the fixing member is exposed to allow the front wall to be disassembled from the side wall; and when the protecting member shields the fixing member, the socket is entirely exposed to allow the plug to be inserted into the socket.

2. The electronic device of claim 1, wherein the front wall comprises a pair of positioning portions cooperatively engaging with the protecting member to limit movement directions of the protecting member.

3. The electronic device of claim 2, wherein the positioning portions are arranged offset relative to each other, and engage with two opposite edges of the protecting member.

4. The electronic device of claim 1, wherein the protecting member is also elastically connected to the front wall.

5. The electronic device of claim 4, wherein the protecting member comprises a slider and a torsion spring used to drive the slider to slide relative to the front wall, the slider comprises a body, a first shielding portion and a second shielding portion, the body closely and slidably abutting the front wall, and the first shielding portion and the second shielding portion respectively close to the socket and the fixing member.

6. The electronic device of claim 5, wherein the body defines a sliding groove extending between the first shielding portion and the second shielding portion, the front wall defines a hole, the sliding groove is opposite to the hole, and a fastener passes through the sliding groove and is screwed into the hole to position the slider relative to the front wall.

7. The electronic device of claim 5, wherein the first shielding portion comprises an inclined surface, and the inclined surface is pushable by the plug to urge the slider away from the socket.

8. The electronic device of claim 5, wherein the second shielding portion comprises a shielding board and a connecting board connected between the shielding board and the body, and the shielding board and the body are parallel with each other and respectively located on two sides of the connecting board.

9. The electronic device of claim 5, wherein the body defines a sliding groove extending between the first shielding portion and the second shielding portion, the torsion spring comprises a first fixing end fixed to the body, a second fixing end fixed to the front wall, and a central portion, and a fastener passes through the central portion and the sliding groove of the body and is screwed into the front wall.

10. The electronic device of claim 9, wherein the body comprises a securing portion formed on an outer surface thereof away from the front wall, the securing portion defines a securing slot used to secure the first fixing end of the torsion spring, and the front wall comprises a retaining portion located between the protecting member and the fixing member and used to fix the second fixing end of the torsion spring.

11. An electronic device, comprising:

a socket, used to engagingly receive a plug to provide power for the electronic device;

a fixing member, used to fix the electronic device to an associated device; and a protecting member, slidably positioned between the socket and the fixing member, and slidable between a first position in which the protecting member shields at least part of the socket and a second position in which the protecting member shields the fixing member;

wherein when the protecting member is in the first position, the fixing member is exposed to allow the electronic device to be disassembled from the associated device, and when the protecting member is in the second position, the socket is entirely exposed to allow the plug to be inserted into the socket.

12. The electronic device of claim 11, wherein the electronic device comprises a front wall, in which the socket is defined, the front wall comprises a pair of positioning portions cooperatively engaging with the protecting member to limit movement directions of the protecting member.

13. The electronic device of claim 12, wherein the positioning portions are arranged offset relative to each other, and engage with two opposite edges of the protecting member.

14. The electronic device of claim 11, wherein the electronic device comprises a front wall, in which the socket is defined, the protecting member is also elastically connected to the front wall.

15. The electronic device of claim 14, wherein the protecting member comprises a slider and a torsion spring used to drive the slider to slide relative to the front wall, the slider comprises a body, a first shielding portion and a second shielding portion, the body closely and slidably abutting the front wall, and the first shielding portion and the second shielding portion respectively close to the socket and the fixing member.

16. The electronic device of claim 15, wherein the body defines a sliding groove extending between the first shielding portion and the second shielding portion, the front wall defines a hole, the sliding groove is opposite to the hole, and a fastener passes through the sliding groove and is screwed into the hole to position the slider to the front wall.

17. The electronic device of claim 15, wherein the first shielding portion comprises an inclined surface, and the inclined surface is pushable by the plug to urge the slider away from the socket.

18. The electronic device of claim 15, wherein the second shielding portion comprises a shielding board and a connecting board connected between the shielding board and the body, and the shielding board and the body are parallel with each other and respectively located on two sides of the connecting board.

19. The electronic device of claim 15, wherein the body defines a sliding groove extending between the first shielding portion and the second shielding portion, the torsion spring comprises a first fixing end fixed to the body, a second fixing end fixed to the front wall, and a central portion, and a fastener passes through the central portion and the sliding groove of the body and is screwed into the front wall.

20. The electronic device of claim 19, wherein the body comprises a securing portion formed on an outer surface thereof away from the front wall, and the securing portion defines a securing slot used to secure the first fixing end of the torsion spring, the front wall comprises a retaining portion located between the protecting member and the fixing member and used to fix the second fixing end of the torsion spring.

* * * * *